US009266712B2

(12) United States Patent
Grimes

(10) Patent No.: US 9,266,712 B2
(45) Date of Patent: Feb. 23, 2016

(54) SADDLE ACCESSORY APPARATUS

(76) Inventor: Julie Grimes, Micanopy, FL (US)

( * ) Notice: Subject to any disclaimer, the term of this patent is extended or adjusted under 35 U.S.C. 154(b) by 178 days.

(21) Appl. No.: 13/449,301

(22) Filed: Apr. 17, 2012

(65) Prior Publication Data

US 2012/0260614 A1 Oct. 18, 2012

Related U.S. Application Data

(60) Provisional application No. 61/476,285, filed on Apr. 17, 2011.

(51) Int. Cl.
*B68C 1/12* (2006.01)
*B68C 1/20* (2006.01)

(52) U.S. Cl.
CPC .. *B68C 1/126* (2013.01); *B68C 1/20* (2013.01)

(58) Field of Classification Search
CPC ..... B68C 1/02; B68C 1/025; B68C 1/00; B68C 1/04; B68C 2001/044; B68C 1/20; B68C 1/08; B68C 1/10; B68C 2001/042; B68C 1/126; A01K 13/006
USPC ..... 54/44.1, 44.5, 44.7
See application file for complete search history.

(56) References Cited

U.S. PATENT DOCUMENTS

| | | | | |
|---|---|---|---|---|
| 426,934 | A * | 4/1890 | Heffernan | 54/44.7 |
| 5,123,233 | A * | 6/1992 | Majewski | 54/46.1 |
| 5,179,821 | A * | 1/1993 | Hiser | 54/44.1 |
| 5,782,070 | A * | 7/1998 | Knight et al. | 54/66 |
| 2002/0104294 | A1 * | 8/2002 | Hainline | 54/44.5 |
| 2005/0110314 | A1 * | 5/2005 | Buselmeier | 297/219.11 |

FOREIGN PATENT DOCUMENTS

GB 2279546 A * 1/1995 ..... B68C 1/04

* cited by examiner

*Primary Examiner* — Kathleen Alker
(74) *Attorney, Agent, or Firm* — Massinger Law Offices

(57) ABSTRACT

A saddle accessory apparatus is comprised of at least one panel of fabric material having a saddle seat covering portion shaped and sized to cover a saddle seat when mounted thereupon, and first and second flap portions, each extending from opposing sides of the seat covering portion and sized and shaped to cover the stirrup leathers of an English-style saddle, and all or substantially all of the fenders of a Western-style saddle. The apparatus protects the rider's bare legs when riding in shorts. Another embodiment of the apparatus includes riding implement retention means for retention of crops, bats, rods and the like and preventing them from falling to the ground if accidentally dropped.

1 Claim, 5 Drawing Sheets

SADDLE ACCESSORY APPARATUS

RELATED APPLICATION

This application claims the benefit of U.S. Provisional Application No. 61/476,285 filed Apr. 17, 2011 and entitled, Saddle-Mounted Leg Protection Apparatus.

FIELD OF THE INVENTION

The present invention relates generally to an equestrian riding saddle accessory device for improving rider comfort and safety.

BACKGROUND OF THE INVENTION

Horseback riding for pleasure, sport or work is an activity engaged in the world over. Despite the longstanding popularity of horseback riding which can be measured in terms of millennia, riders continue to experience blisters, sores, scrapes, rashes and other such irritations on the legs, particularly the inner portions of the calves and thighs which result from movement of the legs in contact with various saddle parts. A wide variety of protective clothing and articles have been-developed over time to obviate this problem. All of them involve incorporation of a protective material between the rider's leg and saddle. Nearly all are worn by the rider or attached to the rider's legs.

For example, it is a common practice for riders, particularly those engaged in English-style riding, to wear riding breeches. Riding breeches are specifically designed for equestrian activities. Traditionally, they were tight in the legs, stopping about halfway down the calf, and had a pronounced flare through the thighs that allowed freedom of movement for the rider. However, with the advent of modern stretch materials such as spandex, modern breeches have no flare and fit skin-tight. Some are adapted with a gripping material, usually leather or a "grippy" synthetic on the inside of the thigh, knee and/or calf area to prevent wear and protect the skin. They are often worn with half chaps which are sturdy coverings for the legs that extend from the ankle to just below the knee. They afford protection from sweat and the stirrup leather component of English saddles.

In Western disciplines, it is more common to wear denim pants, some of which are specifically designed for riding in that they have eliminated the bulky inseam which tends to rub against the skin when riding. Western-style riders also wear a wide variety of accessories designed to protect the legs. Examples are chaps, chinks, armitas, woolies, and zamorros. Some of these are intended to protect the outer leg rather than the inner, but most afford protection to both.

A significant shortcoming of most of the above prior art leg wear articles is that they can be bulky and tend to retain heat generated by the wearer when riding, causing excessive sweating which can lead to skin irritations and discomfort. Particularly in warmer climates wearing of such articles is often undesirable. In fact, in warm climates it is often the desire of many riders to wear shorts rather than long pants and other protective wear in order to reduce sweating and expose the legs to the sun while riding. Such a practice, of course; is uncommon because having no layer of protection between the inner leg and saddle parts can easily damage the rider's skin.

One solution to the above described problem is described in U.S. Pat. No. 5,123,233 issued to Majewski in 1992 which describes a method and apparatus for protecting a rider's legs while riding horseback on an English-style saddle. The Majewski apparatus suffer from certain shortcomings and limitations not the least of which is that it is not intended or suited for Western-style saddles. Moreover, the Majewski apparatus does not shield the rider's inner leg from contact with the saddle skirt, the free-end of the stirrup leathers, or the stirrup leather keeper. While the Majewski apparatus is likely useful in protecting the lower leg of the rider, it does not protect the entire leg. Moreover, it is not suitable for use on Western saddles which have a considerably different architecture than English-style saddles.

Other problems frequently encountered by Western and English riders who utilize communication aids (also referred to herein as "implements") in the form of a riding crops, bats, rods and the like while mounted atop a horse are that the communication aids, are frequently dropped by accident and there exist no effective means for temporarily stowing them on the saddle if the rider requires full use of their hands. When accidentally dropped, the rider is required to dismount in order to retrieve the implement. Temporary storage of the implement to gain full use of the rider's hands is usually accomplished by wedging the implement between the rider's thigh and the underlying saddle, and hoping that it doesn't drop out. Naturally, this method is uncomfortable and restricts the rider's freedom of movement, particularly during the post.

Accordingly, there is a need in the all for a leg protection apparatus that may be mounted to virtually any type saddle, whether English, Western or otherwise, and that protects the full length of the rider's inner leg while riding in short pants or thin leggings. Moreover, there is a need in the art for such an apparatus that includes means for temporarily stowing communication implements such as riding crops, bats, rods and the like while the rider is mounted, and for preventing such implements from being accidentally dropped.

SUMMARY OF THE INVENTION

The subject apparatus meets the need in the art by providing a universal saddle-mounted accessory apparatus comprised of an elongated panel of at least one fabric material, the panel having a saddle-contacting side and a rider-contacting side, the panel being further comprised of: a) a saddle seat covering portion shaped and sized to cover a saddle seat when mounted thereupon, and b) first and second flap portions, each extending from opposing sides of the seat covering portion and sized and shaped to cover the stirrup leathers of an English-style saddle, and all or substantially all of the fenders of a Western-style saddle. The seat covering portion includes seat size adjustment means. Each flap portion includes length adjustment means. Both seat covering portion and flap portions include mounting means for temporary attachment to a saddle. In a preferred embodiment, the seat covering portion is constructed of two layers: a saddle-contacting layer preferably but not essentially constructed of leather or synthetic material having saddle "gripping" properties to reduce slippage, and a rider-contacting layer constructed of machine washable, shrink resistant material soft and smooth to the touch such as a cotton blend or Merino Sheepskin. The two layers may be permanently connected via stitching or separable and removably connected using various connecting means such as hook and loop fasteners, zippers or the like. In one embodiment, seat covering portion includes a closable pocket on its saddle-contacting side for the removable receipt of padding, gel cushions and the like for added rider comfort. In another embodiment, the flap portions are removably attached to seat covering portion such that the latter can still be used to protect the saddle seat from soiling and to provide rider comfort. In yet another embodiment of the subject saddle accessory apparatus, communication aid retention means are included for preventing the communication aid from falling to the ground if accidentally or intentionally dropped by the rider, and for retaining the communication aid in a safe and easy to reach position when not in use.

There has thus been outlined, rather broadly, the more important components and features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide a leg protection apparatus for horseback riders wherein the apparatus is capable of being mounted to a saddle generally, and over the skin-contacting surfaces thereof in particular, in order to facilitate horseback riding in short pants.

It is another primary object of the subject invention to provide a saddle-mountable leg protection apparatus suitable for mounting on virtually any style saddle, including both English and Western saddles.

Another primary object of the subject invention is to provide a saddle-mountable leg protection apparatus having communication aid retention means for preventing the aid from falling to the ground if accidentally or intentionally dropped by the rider, and for retaining the device in a safe and easy to reach position when hot in use.

It is also an object of the subject invention to provide a saddle-mountable leg protection apparatus that also protects the saddle seat from staining.

Another object of the subject invention is to provide a saddle mountable leg protection apparatus which is relatively simple in design and therefore capable of rapid construction at relatively low costs.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

BRIEF DESCRIPTION OF THE DRAWINGS

The foregoing summary of the invention, as well as the following detailed description of preferred embodiments, is better understood when read in conjunction with the accompanying drawings, which are included by way of example, and not by way of limitation with regard to the claimed invention.

DETAILED DESCRIPTION OF THE PREFERRED EMBODIMENT

Figure 1:
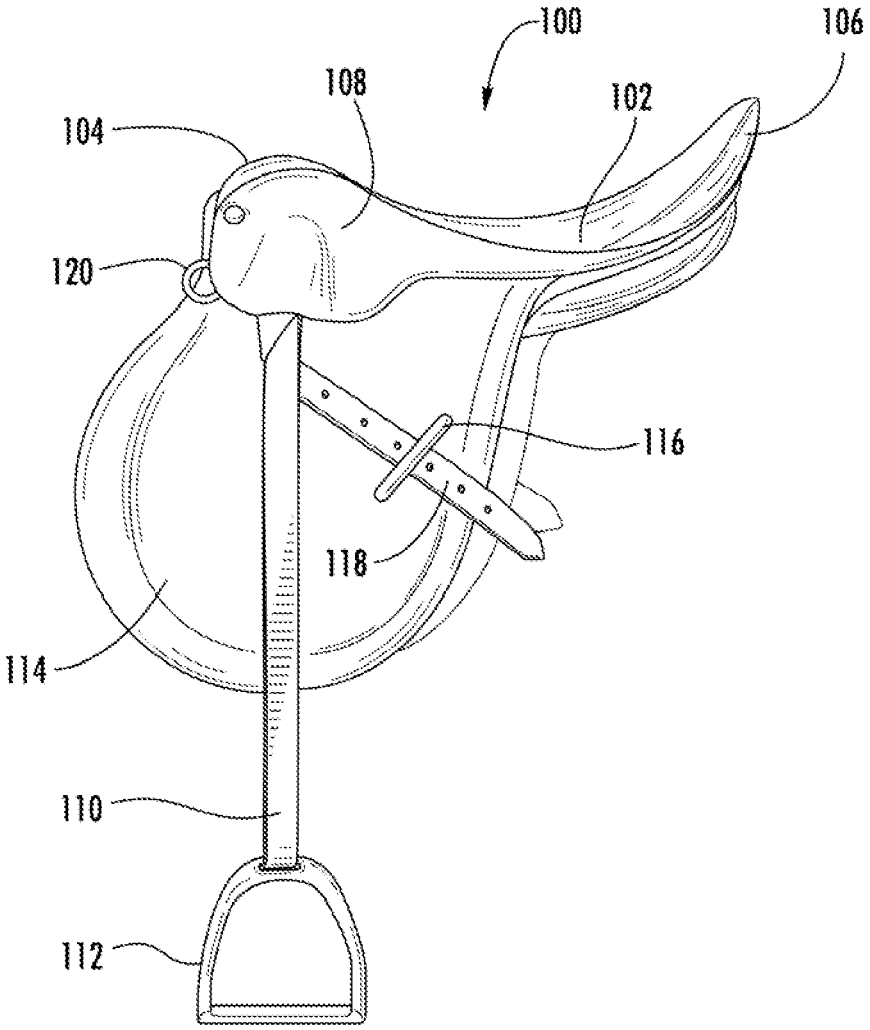
FIG. 1 (PRIOR ART)
FIG. 1 is a side view of a conventional English saddle to which the subject leg protection apparatus may be mounted.

It should be clearly understood at the outset that like reference numerals are intended to identify the same structural elements, portions or surfaces consistently throughout the several drawings herein, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, any reference to the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Before the subject invention and its advantages can be fully appreciated, it is first necessary to understand the relevant components of the two primary types of saddles to which the subject apparatus may be attached, namely an English-style saddle and a Western-style saddle. Accordingly, reference is first made to FIG. 1 in which there is illustrated a convention English saddle designated generally by reference numeral 100 and comprising a seat 102 where the rider sits, a pommel 104 which is the front, slightly raised area of the saddle, a cantle 106 which is the rear, slightly raised area of the saddle, the skirt 108 which is lateral to each side of seat 102 and covers the hardware used to mount stirrup leathers 110 which in turn support stirrups 112. A pair of large saddle flaps 114 hangs from each side of the seat and pommel areas, cover the saddle rigging (not shown) and separate the stirrup leathers and rider's legs from contacting the side of the horse. A keeper 116 is mounted to each saddle flap 114 for receiving the free-end 118 of each corresponding stirrup leather 110.

During riding, the rider's inner leg comes into frictional contact with skirt 108, stirrup leathers 110 including free-end 118 thereof, saddle flaps 114, and keepers 116, all of which would irritate unprotected skin.

Figure 2:
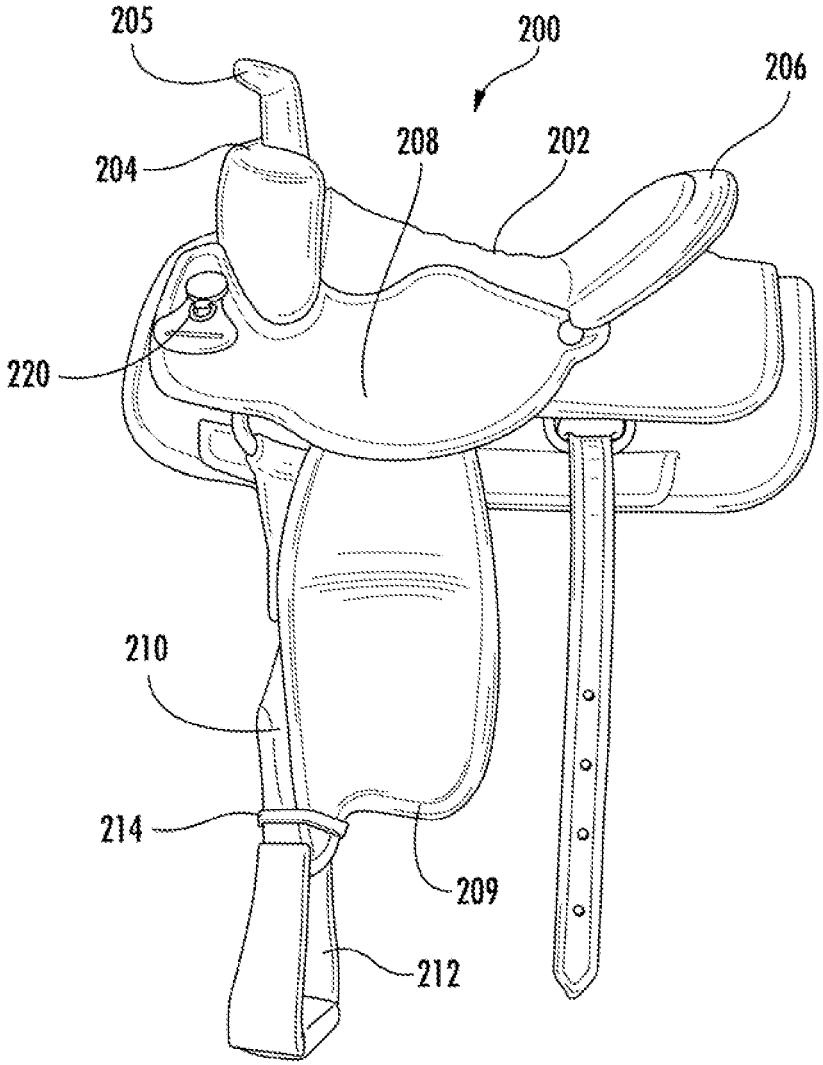
FIG. 2 (PRIOR ART)
FIG. 2 is a side view of a conventional Western saddle to which the subject leg protection apparatus may be mounted.

The basic construction of a Western-style saddle is similar in some respects to an English saddle, but there are important distinctions relevant to the subject saddle accessory apparatus 10. Referring now to FIG. 2, a conventional Western-style saddle, designated generally by reference numeral 200 comprises a seat 202, a generally c-shaped swell 204 at the front of the seat (where pommel 104 is on an English saddle) typically including a horn 205 at its apex, an elevated cantle 206 at the rear of seat 202 (typically much higher than those of English saddles), a seat jockey 208 (similar to the English saddle's skirt in function), a pair of wide fenders 209 suspended from mounting hardware (not shown) located under seat jockey 208 and terminating in stirrup leathers 210, and stirrups 212 mounted to stirrup leathers 210. A pair of hobble straps 214 (no equivalent in English saddles) is used to manage each stirrup leather 210 which are set to the desired length and locked in place using Blevins (not shown). During riding, the rider's inner leg comes into frictional contact with seat jockey 208 which often has thick hard edges, fenders 209 which also have thick hard edges, stirrup leathers 210, and hobble straps 214, all of which would irritate unprotected skin. Moreover, the fenders 209 and seat jockey 208 of Western saddles are frequently adorned with tooling which would increase friction between a rider's unprotected skin and these non-smooth surfaces.

Figure 3:
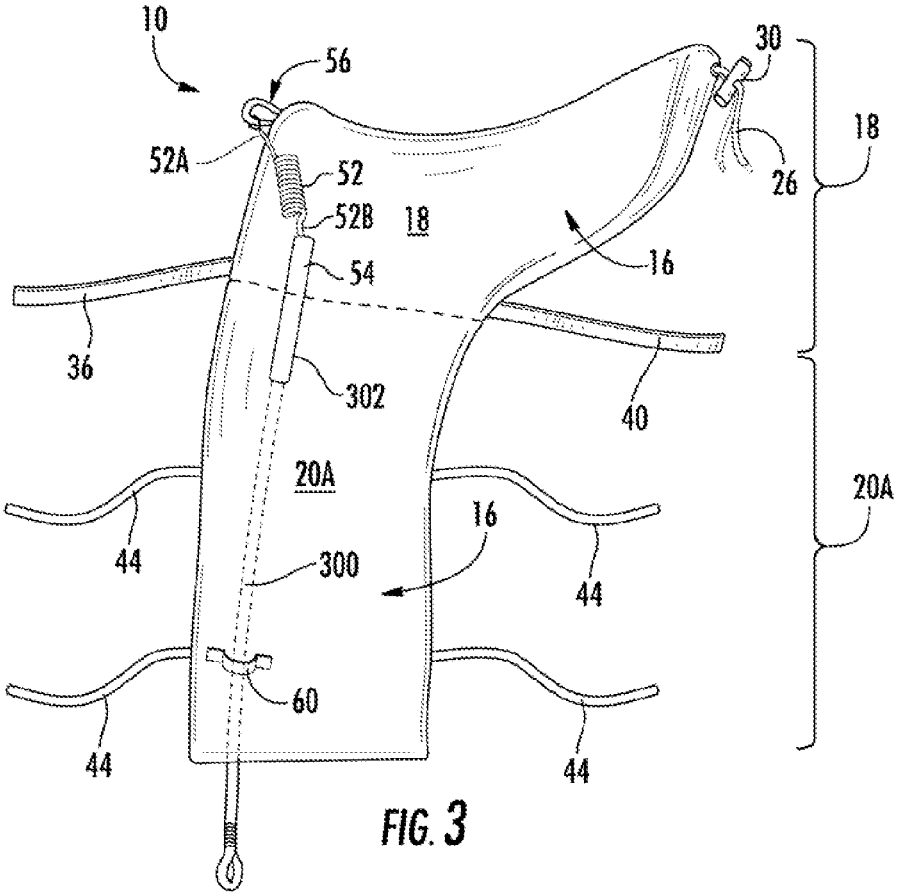
FIG. 3 is a side view of a saddle-mounted leg protection apparatus of the subject invention.
Figure 4:
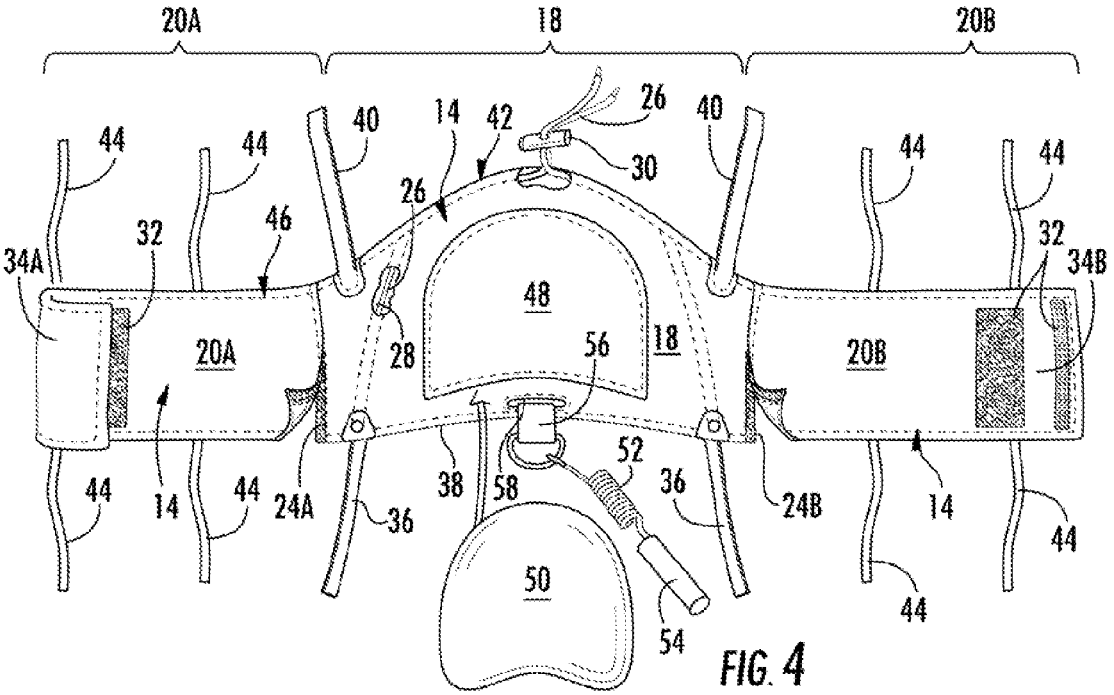
FIG. 4 is a bottom view of the apparatus of FIG. 3.
Figure 5:
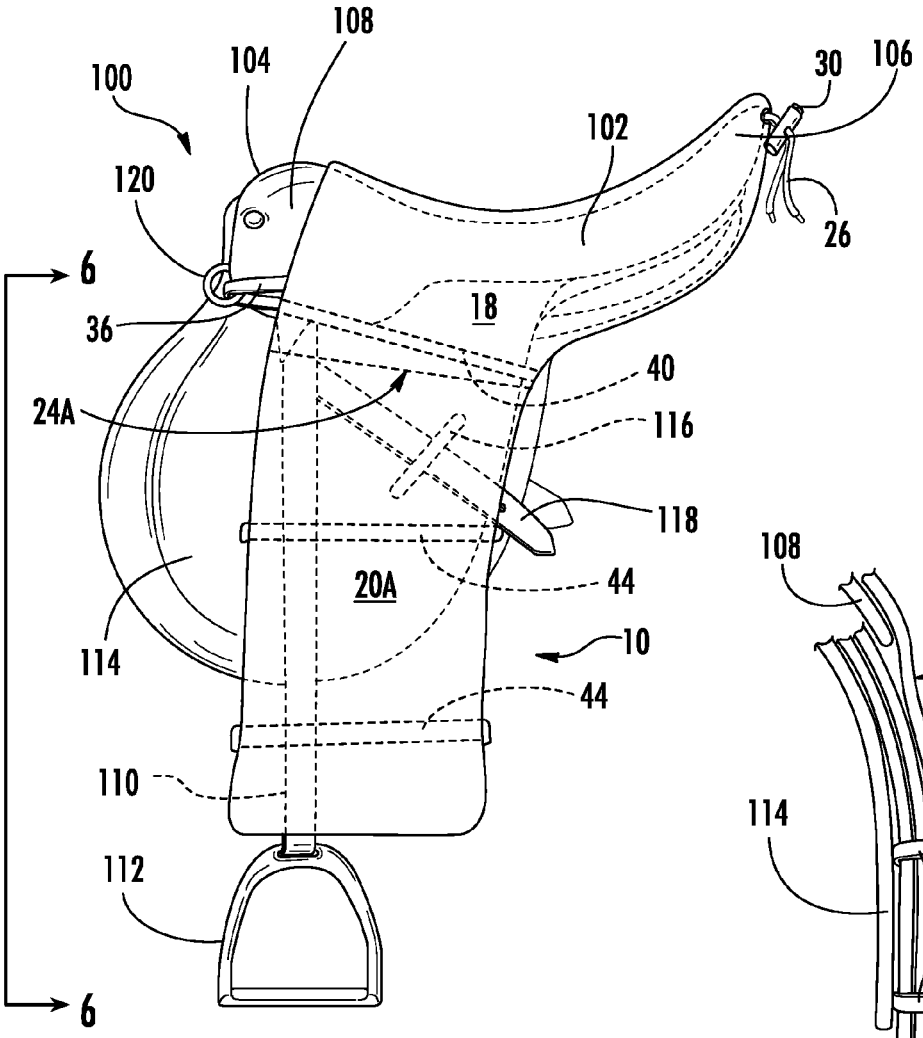
FIG. 5 is a side view of the subject leg protection apparatus shown mounted to an English saddle portions of which are shown in phantom view.

Reference is now made to FIGS. 3 and 4 in which there is illustrated side and bottom views, respectively, of a first embodiment of the subject saddle-mounted leg protection apparatus designated generally by reference numeral 10 (hereinafter also referred to as "saddle accessory apparatus"). A first embodiment of the saddle-mounted leg protection apparatus 10 is comprised of an elongated form-fitting panel 12 constructed of at least one fabric material, the panel having a saddle-contacting side 14 (FIG. 4) and a rider-contacting side 16 (FIG. 3), panel 12 being further comprised of: a) a saddle seat covering portion 18 shaped and sized to cover at least seat 102 and leg-contacting portions of skirt 108 of English saddle 100, and at least seat 202 and leg-contacting portions of seat jockey 208 of Western-style saddle 200, when mounted thereupon, and b) first and second flap portions 20A,20B, each extending laterally from opposing side edges 24A,24B, respectively, of seat covering portion 18 and sized and shaped to cover stirrup leathers 110 including the free-end 118 thereof, keepers 116, and leg contacting portions of flaps 114 of English-style saddle 100, and leg-contacting surfaces of fenders 209, stirrup leathers 210, and hobble straps 214 of a Western-style saddle.

The seat covering portion 18 includes seat size adjustment means which in one embodiment is comprised of a drawstring 26 housed within a channel 28 located about at least a portion of the perimeter of seat covering portion 18 and cord lock 30 in slidable and lockable engagement with the ends of said drawstring to keep it taught in a manner well known in the art.

Figure 6:
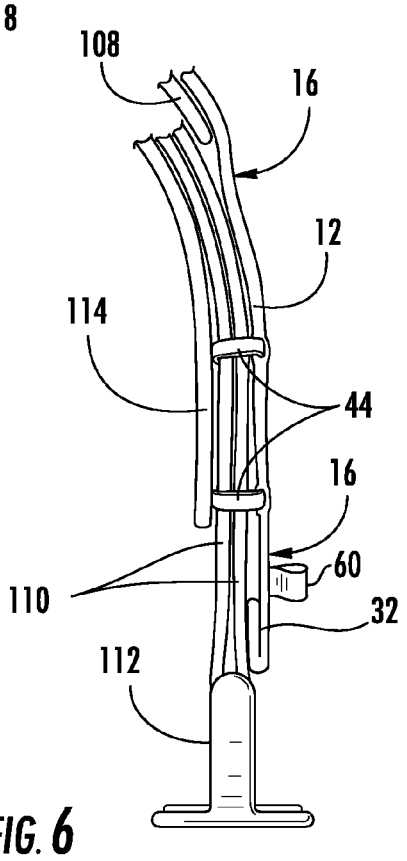
FIG. 6 is a frontal view of the apparatus of FIG. 5 taken along line 6-6.
Figure 7:
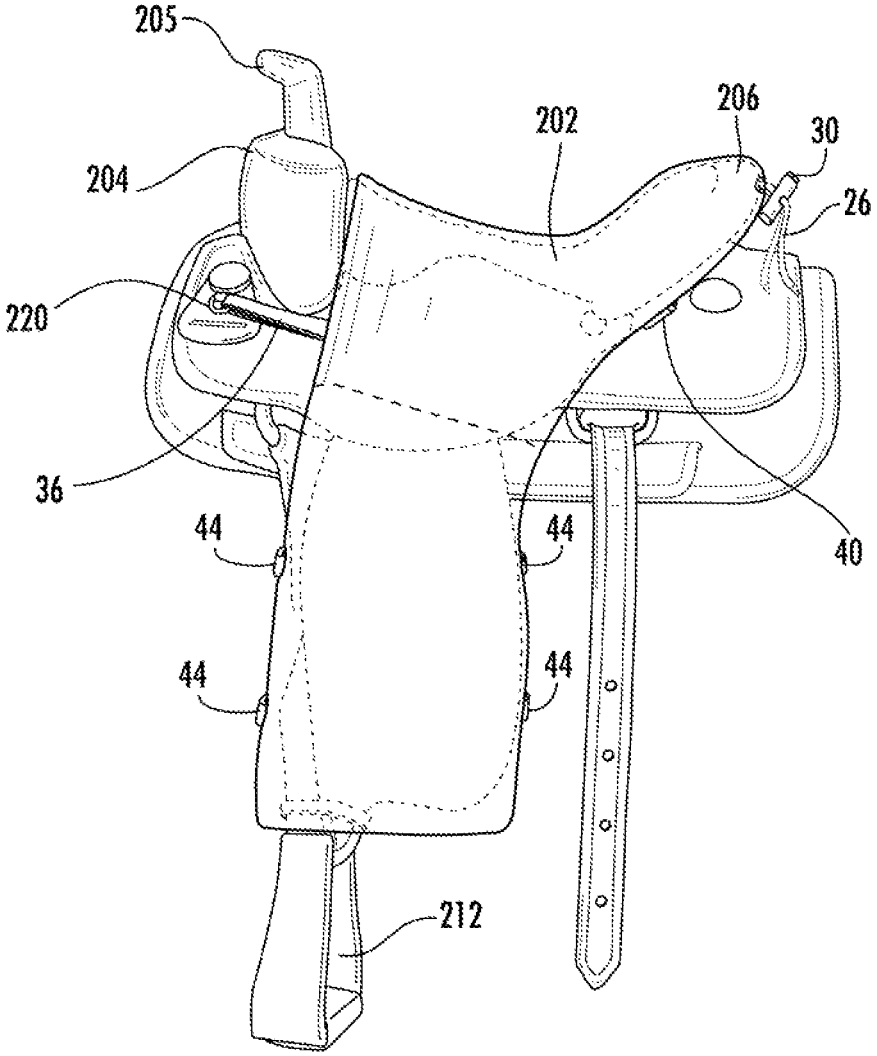
FIG. 7 is a side view of a conventional Western saddle to which the subject leg protection apparatus is mounted.

Each flap portion 20A,20B includes length adjustment means 32. In one embodiment, adjustment means 32 may be strips of hook and loop tape fastened to saddle-contacting side 14 of each flap portion 20A,20B near ends 34A,34B such that ends 34A,34B can be folded under and temporarily secured in place to achieve the desired length of the flaps as illustrated in FIGS. 4 and 6.

Both seat covering portion 18 and flap portions 20A,20B include mounting means for removably securing apparatus 10 to a saddle. In one embodiment, the mounting means are comprised of a pair of pommel straps 36 fixedly attached to the leading edge 38 of seat covering portion 18, and a pair of cantle straps 40 fixedly attached at one end to the trailing edge 42 of seat covering portion 18. The term "strap" as used herein may be a strap equipped with buckles, quick-release clips, hook and loop fasteners or the like, or strings, cords and the like which can be tied. As may be appreciated, pommel straps 36 may be secured to the front of saddle 100,200 in a variety of ways such as, by insertion through available d-rings 120,220 or tying to cooperating cantle straps 40 underneath the saddle flaps 114 of an English saddle 100. For flap portions 20A,20B, mounting means may be at least one pair of flap straps 44 which are tied or otherwise secured together behind stirrup leathers 110 of English saddle 100 or behind fenders 209 of Western saddle 200.

In a preferred embodiment, seat covering portion 18 is constructed of two layers: a saddle-contacting layer preferably but not essentially constructed of leather or synthetic material having saddle "gripping" properties to reduce slippage, and a rider-contacting layer constructed of machine washable, shrink resistant material soft and smooth to the touch such as a cotton blend or Merino Sheepskin. The two layers are permanently connected via perimeter stitching 46.

In one embodiment, seat covering portion includes a closable pocket 48 fixedly attached to saddle-contacting side 14 via stitching or other suitable means. Pocket 48 is sized and shaped to receive cushion member 50 which may be any form of padding such as closed cell foam, gel or the like designed to provide added rider comfort.

In another embodiment, the flap portions 20A,20B are removably attached to seat covering portion 18 rather than integrally formed together so that flap portions 20A,20B can be removed while seat covering portion 18 remains attached to the saddle 100,200. Such an arrangement is useful when the rider is wearing suitable leg protection, but still desires to protect the saddle seat 102,202 from soiling and staining from rider sweat, and to be afforded additional rider comfort as provided by cushion member 50.

In yet another embodiment, the subject apparatus further includes communication aid retention means for preventing elongated communication aids such as whips, rods, bats, crops and the like from falling to the ground if accidentally or intentionally dropped by the rider, and for retaining the communication aid in a safe and easy to reach position when not in use. In a preferred embodiment, communication aid retention means comprise an elastic cord 52 having a proximal end 52A attached to seat covering portion 18 via cord mounting means, described below, and a distal end 52B which terminates in communication aid mounting means for removable attachment to the handle 302 of an elongated communication aid 300 (FIG. 3). The term "cord" as used in this context is a single elastic cord, fiber or a bundle of elastic cords or fibers woven or otherwise formed together. The cord is constructed of a durable coiled tinsel wire coated in an elastomeric material or may have any other construction characterized by its capability of returning to its original length, shape, etc., after being stretched to several times its original length. Such a characteristic affords freedom of movement of the communication aid away from its point of attachment to seat portion 18 when manipulated by the rider, and facilitates its return to the aid's "resting position" in close proximity to the pommel of the saddle when accidentally or intentionally dropped by the rider. In the latter instance, the communication aid will dangle along either side of the horse and in front of the rider for easy retrieval when needed. The communication aid mounting means is preferably but not essentially comprised of an elastic sleeve 54 sized and shaped for frictional engagement with and around at least a portion of the handle 302 of a communication aid 300. Sleeve 54 may be rolled on and off of the handle. Alternatively, sleeve 54 can be secured to handle 302 using hook and loop tape or using other suitable mounting means. The proximal end 52A of cord 52 is mounted to seat portion 18 via cord mounting strap 56 which may be a strap equipped with buckles, quick-release clips, hook and loop fasteners or the like, or strings, cords and the like which can be tied. Cord mounting strap 56 is fastened to seat portion 18 generally, and preferably but not essentially through a slot 58 located at the midpoint of leading edge 38. In order to prevent the communication aid from excessive movement when not in use, at least one communication aid retention ring 60 of leather, cloth, metal or any other suitable material is fixedly attached to each flap portion 20A,20B forward of the rider's leg and preferably but not essentially below the rider's knee. As may be best appreciated upon reference to FIG. 3, the distal end of the communication aid may be inserted through the retention ring 60 to limit non-axial movement of the aid when dangled from the above described communication aid retention means.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. An accessory apparatus for an English-style saddle comprising a seat, a pair of saddle flaps, a pair of stirrup leathers and a skirt with leg-contacting portions, and also for a Western-style saddle comprising a seat, a pair of fenders terminating in a pair of stirrup leathers managed by a pair of hobble straps, and a set jockey with leg-contracting portions, the accessory apparatus comprising a form-fitting panel having a saddle-contacting side and a rider-contacting side, said panel including: a) a saddle seat covering portion sized and shaped to cover at least the seat and leg-contacting portions of the skirt of said English-style saddle, and at least the seat and leg-contacting portions of the seat jockey of said Western-style saddle, b) a first flap portion extending from a first side edge of said seat covering portion, c) a second flap portion extending from a second side edge of said seat covering portion; said first flap portion and said second flap portion each being sized and shaped to cover the stirrup leathers and the leg contacting portions of the flaps of the English-style saddle, and the leg-contacting surfaces of the fenders, the stirrup leathers, and the hobble straps of the Western-style saddle; said first flap portion and said second flap portion including length adjustment means for longitudinally adjusting the length of said first flap portion and said second flap portion to cover stirrup leathers of different longitudinal lengths; and d) communication aid retention means for retaining an elongated communication aid having a handle, said communication aid retention means comprising, an elastic cord having a proximal end attached to said saddle seat covering portion, and a distal end terminating in an elastic sleeve sized and shaped for removable frictional engagement with at least a portion of the handle of an elongated communication aid.

* * * * *